US008368377B2

(12) United States Patent
Liu

(10) Patent No.: US 8,368,377 B2
(45) Date of Patent: Feb. 5, 2013

(54) VOLTAGE REGULATOR ARCHITECTURE

(75) Inventor: Jun Liu, Shenzhen (CN)

(73) Assignee: STMicroelectronics (Shenzhen) R&D Co. Ltd., Shenzhen (CN)

( * ) Notice: Subject to any disclaimer, the term of this patent is extended or adjusted under 35 U.S.C. 154(b) by 274 days.

(21) Appl. No.: 12/938,244

(22) Filed: Nov. 2, 2010

(65) Prior Publication Data

US 2011/0109296 A1 May 12, 2011

(30) Foreign Application Priority Data

Nov. 10, 2009 (CN) ..... 2009 1 0208331

(51) Int. Cl.
*G05F 3/20* (2006.01)
*G05F 3/26* (2006.01)

(52) U.S. Cl. ..... 323/314; 323/315

(58) Field of Classification Search ..... 323/311, 323/312, 313, 314, 315
See application file for complete search history.

(56) References Cited

U.S. PATENT DOCUMENTS 4,965,510 A * 10/1990 Kriedt et al. ..... 323/315
5,732,028 A * 3/1998 Shin ..... 365/189.09
6,285,244 B1 * 9/2001 Goldberg ..... 327/539
6,433,621 B1 * 8/2002 Smith et al. ..... 327/538
6,894,473 B1 * 5/2005 Le et al. ..... 323/314
7,301,322 B2 * 11/2007 Choi ..... 323/315
7,764,059 B2 * 7/2010 Migliavacca ..... 323/316
7,915,882 B2 * 3/2011 Hellums ..... 323/312

* cited by examiner

*Primary Examiner* — Gary L Laxton
(74) *Attorney, Agent, or Firm* — Slater & Matsil, L.L.P.

(57) ABSTRACT

An integrated circuit includes a bandgap reference generator and a voltage regulator. The bandgap reference generator includes a first current path, and a first bipolar transistor with an emitter-collector path in the first current path. The voltage regulator includes a second current path, wherein the second current path mirrors the first current path; a resistor configured to receive a current of the second current path; a second bipolar transistor with a base and a collector of the second bipolar transistor being interconnected; and a third bipolar transistor connected in series with the second bipolar transistor and the resistor. A base and a collector of the third bipolar transistor are interconnected.

19 Claims, 2 Drawing Sheets

VOLTAGE REGULATOR ARCHITECTURE

CROSS-REFERENCE TO RELATED APPLICATION

This application claims the priority benefit of China Patent Application No. 200910208331.3, filed on Nov. 10, 2009, and entitled "Voltage Regulator Architecture," which is hereby incorporated by reference to the maximum extent allowable by law.

TECHNICAL FIELD

This invention relates generally to integrated circuit design, and more particularly to voltage regulators, and even more particularly to internal bandgap and regulator circuits.

BACKGROUND

In typical analog circuits such as DC-DC converters, internal bandgap and regulator circuits are commonly used to generated reference voltages and internal VCC voltages. As the name suggests, the voltages generated by the bandgap reference generators are used as references, and hence the outputted reference voltages need to be highly stable. To be specific, the outputted reference voltages need to be free from temperature variations, voltage variations, and process variations. Voltage regulators may also be connected to exploit the advantageous features of the highly stable reference voltages, and to regulate or convert the reference voltages to higher or lower stable voltages, for example, VCC voltages.

FIG. 1 illustrates a circuit diagram of a conventional bandgap and regulator circuit, which includes a bandgap reference generator and a voltage regulator. PMOS transistors M0' and M1' form a current mirror. Bipolar transistors Q0' and Q1' are used to compensate for the temperature variation in the resulting reference voltage VA' at node A'. The generated reference voltage VA' can be expressed as:

$$VA' = \Delta VBE \times (R1 + R0)/R0 + VBE0 \quad \text{[Eq. 1]}$$

Wherein ΔVBE is equal to (VBE1−VBE0), with voltage VBE1 being the base-to-emitter voltage of bipolar transistor Q1', and voltage VBE0 being the base-to-emitter voltage of bipolar transistor Q0'. Appropriate values are selected for the devices in the circuit shown in FIG. 1. For example, if a ratio of the area of bipolar transistor Q0' to the area of bipolar transistor Q1' is 8:1, and resistance ratio R1':R0' is 4, reference voltage VA' equal to about 1.25V may be generated. Further, reference voltage VA' may have a zero temperature coefficient at room temperature. The voltage regulator includes operational amplifier OP, PMOS transistor M10', and resistors R3' and R4'. By selecting resistor R3' to have a same resistance as resistor R4', the resulting voltage VCC may be about 2.5V. Voltage VCC has a smaller variation than the external voltage VIN'.

The conventional internal bandgap and regulator circuit as shown in FIG. 1, however, suffers from drawbacks. Due to the use of operational amplifier OP, the power consumption is high, and a great die area is required by the internal bandgap and regulator circuit. What is needed, therefore, is a bandgap and regulator circuit for overcoming the above-described shortcomings in the prior art.

SUMMARY OF THE INVENTION

In accordance with an aspect of the invention, an integrated circuit includes a bandgap reference generator and a voltage regulator. The bandgap reference generator includes a first current path, and a first bipolar transistor with an emitter-collector path in the first current path. The voltage regulator includes a second current path, wherein the second current path mirrors the first current path; a resistor configured to receive a current of the second current path; a second bipolar transistor with a base and a collector of the second bipolar transistor being interconnected; and a third bipolar transistor connected in series with the second bipolar transistor and the resistor. A base and a collector of the third bipolar transistor are interconnected.

Other embodiments are also disclosed.

The advantageous features of the embodiments include a reduced power consumption and a reduce die area required by the internal bandgap and regulator circuit.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the embodiments of the present invention are discussed in detail below. It should be appreciated, however, that the embodiments provide many applicable inventive concepts that can be embodied in a wide variety of specific contexts. The specific embodiments discussed are merely illustrative of specific ways to make and use the invention, and do not limit the scope of the invention.

Figure 1:
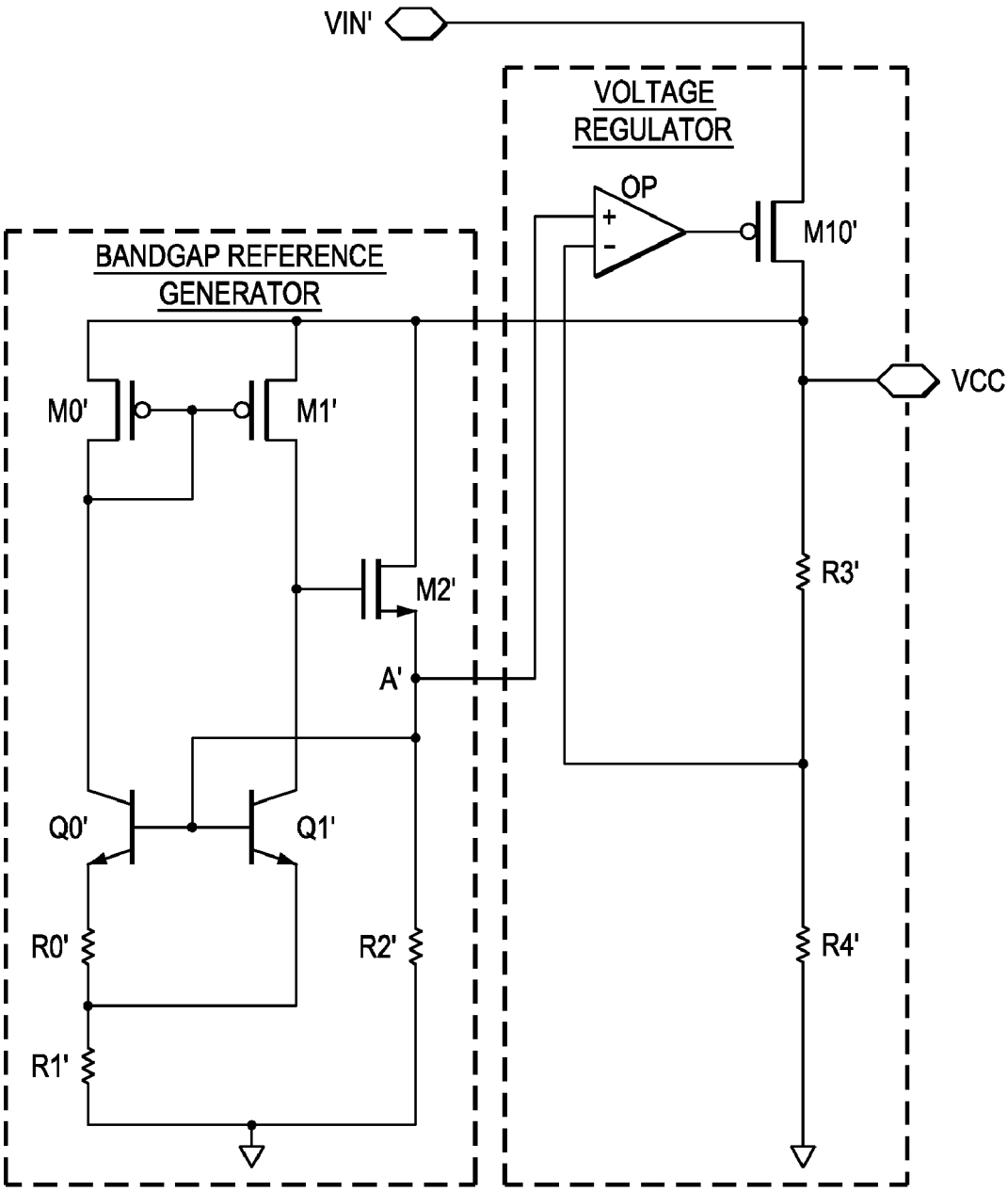
FIG. 1 (PRIOR ART)
FIG. 1 illustrates a conventional internal bandgap and regulator circuit comprising an operational amplifier.
Figure 2:
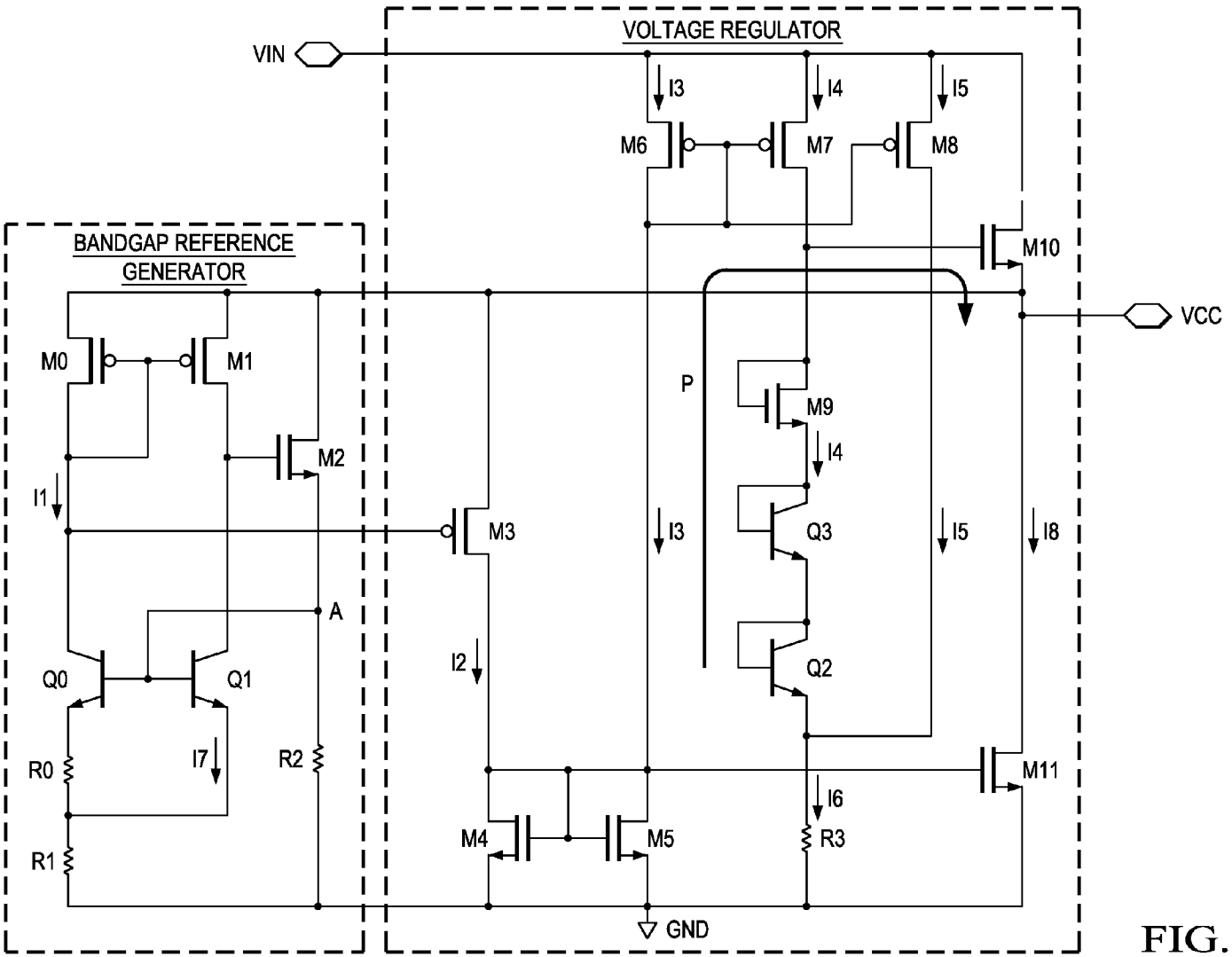
FIG. 2 illustrates a bandgap and regulator circuit in accordance with an embodiment of the invention, wherein no operation amplifier is included.

FIG. 2 illustrates a circuit diagram of a bandgap and regulator circuit in accordance with an embodiment, which includes a bandgap reference generator and a voltage regulator. The bandgap reference generator includes PMOS transistors M0 and M1 having their gates interconnected. The gate and the drain of PMOS transistor M0 are interconnected. Further, the drain of transistor M0 is coupled to the collector of (NPN) bipolar transistor Q0, and the drain of transistor M1 is coupled to the collector of bipolar transistor Q1. The emitter of bipolar transistor Q0 is coupled to resistors R0 and R1, while the emitter of bipolar transistor Q1 is coupled to the connecting point of resistors R0 and R1. The bandgap reference generator further includes NMOS transistor M2 and resistor R2. Resistor R1 may have an end coupled to electrical ground GND.

The voltage regulator includes PMOS transistors M3 and M6-M8, and NMOS transistors M4, M5, and M9-M11. Voltage VIN is an external voltage that may have relatively high variations. It is noted that PMOS transistors M0 and M3 form a current mirror since their gates are interconnected. Accordingly, Current I1 that flows through the source-drain path of PMOS transistor M0 is proportional to current I2 that flows through the source-drain path of PMOS transistor M3. Throughout the description, the term "source-drain path" refers to the path connecting the source and the drain of a transistor. Further, when a first current path is referred to as "mirrored" to a second current path, the currents in the first and the second current paths are proportional, which means that the currents in the first and the second paths will keep substantially a same ratio even if the amplitudes of the first and the second currents may change. In the embodiment wherein ratio (referred to aspect ratio hereinafter) $W/L_{M0}$ (the ratio of gate width to gate length) of transistor M0 is equal to aspect ratio $W/L_{M3}$ of transistor M3, current I1 may be equal to current I2.

NMOS transistors M4 and M5, with their gates interconnected, form another current mirror, and hence current I3 that flows through the source-drain path of NMOS transistor M5 is also proportional to current I2, and proportional to current I1. In the embodiment wherein aspect ratio $W/L_{M4}$ of transistor M4 is equal to aspect ratio $W/L_{M5}$ of transistor M5, current I2 may be equal to current I3. Current I3 also flows through the source-drain path of PMOS transistor M6.

PMOS transistors M6, M7, and M8 also form a current mirror, and hence the source-drain currents I3, I4, and I5 of PMOS transistor M6, M7, and M8, respectively, are proportional to each other. Again, if aspect ratio $W/L_{M6}$ of transistor M6 is equal to aspect ratio $W/L_{M7}$ of transistor M7 and/or aspect ratio $W/L_{M8}$ of transistor M8, current I3 may be equal to current I4 and/or current I5, respectively.

Current I6 that flows through resistor R3 (also referred to as an output resistor hereinafter) equals the sum of currents I4 and I5, which sum will also be proportional to each of currents I4 and I5. Accordingly, current I6 is also mirrored to current I1. Hence, the voltage generator samples current I1 in the bandgap reference generator, and mirrors the sampled current I1 to current I6 through the current mirror formed of NMOS transistors M4 and M5 and the current mirror formed of PMOS transistors M3 and M6-M8. Further, in the embodiment wherein currents I1, I2, I3, I4 and I5 are equal to each other, current I6 may be equal to twice that of current I1, i.e., 2I1.

The output voltage VCC of the voltage regulator can be expressed as (by calculating voltage VCC through the path marked as P in FIG. 2):

$$VCC=I6\times R3+VBE_{Q2}+VBE_{Q3}+VGS_{M9}-VGS_{M10} \quad \text{[Eq. 2]}$$

Wherein voltage $VBE_{Q2}$ is the base-to-emitter voltage of bipolar transistor Q2, voltage $VBE_{Q3}$ is the base-to-emitter voltage of bipolar transistor Q3, voltage $VGS_{M9}$ is the gate-to-source voltage of MOS transistor M9, and voltage $VGS_{M10}$ is the gate-to-source voltage of MOS transistor M10. Voltages $VGS_{M9}$ and $VGS_{M10}$ may cancel each other if NMOS transistors M9 and M10 are designed substantially identical to each other. Further, since NMOS transistor M11 forms a current mirror with transistors M4 and M5, the current I8 flowing through the source-drain path of NMOS transistor M10 may be the same as current I4. Therefore, NMOS transistors M9 and M10 have same gate voltages and same source-to-drain currents, and hence gate-to-source voltages $VGS_{M9}$ and $VGS_{M10}$ are very likely to be the same.

With the canceling of voltages $VGS_{M9}$ and $VGS_{M10}$, voltage VCC may be expressed as:

$$VCC=I6\times R3+VBE_{Q2}+VBE_{Q3} \quad \text{[Eq. 3]}$$

Further by making R3 equal to 2R1, and ($VBE_{Q2}$+$VBE_{Q3}$) equal to $2VBE_{Q1}$, and with current I6 being equal to 2I1, voltage VCC may be expressed as:

$$VCC=I6\times 2R1+2VBE_{Q1}=2(2I1\times R1+VBE_{Q1}) \quad \text{[Eq. 4]}$$

Since current I1 may be equal to current I7 as shown in FIG. 2, 2I1 is the current flowing through resistor R1, and hence 2I1×R1+$VBE_{Q1}$ is equal to reference voltage VA at node A. Therefore, voltage VCC may be equal to twice reference voltage VA, which may be, for example, about 2.5V if reference voltage VA is 1.25V. Voltage VCC, however, has a smaller variation than external input voltage VIN.

In the embodiments discussed in preceding paragraphs, the parameters of the MOS transistors and resistors in the voltage regulator are discussed to demonstrate how voltage VCC can be adjusted to twice the reference voltage VA (2VA). The embodiment as shown in FIG. 2 may also be used to generate different voltages VCC other than 2VA. For example, the aspect ratios of MOS transistors M3 through M10 may be adjusted to increase or decrease the currents in the respective source-drain paths of these transistors, so that currents I3, I4, and I5 may be increased or decreased compared to the above-discussed exemplary embodiment. As a result, current I6 may be increased or decreased, and hence voltage VCC is increased or decreased. In another exemplary embodiment, the resistance of resistor R3 is increased to greater than 2R1 or reduced to smaller than 2R1 in order to adjust voltage VCC.

In yet other embodiments, MOS transistor M8 may be removed, so that current I6 is equal to current I4, and hence voltage VCC is less than twice the reference voltage VA. In yet other embodiments, additional PMOS transistor(s) may be added with the gate, the source and the drain of the additional MOS transistor(s) connected to the gate, the source and the drain of PMOS transistor M8, respectively, so that current I6 may be further increased to three times, four times, or even greater times, of current I1, and hence voltage VCC is further increased. In this case, additional bipolar transistors may be added and connected in series with bipolar transistors Q2 and Q3. As a result, depending on the number of transistors connected in parallel with transistor M8, Equation 4 may be modified as:

$$VCC=m(2I1\times R1+VBE_{Q1}) \quad \text{[Eq. 5]}$$

Wherein m is an integer equal to 1, 3, or a value greater than 3.

The above-described embodiments have several advantageous features. By sensing a current, rather than the reference voltage, in the reference voltage generator, the voltage regulator may have a simple design without using an operational amplifier. The power consumption of the resulting bandgap and regulator circuit is thus reduced, and the required die area is reduced.

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. In addition, each claim constitutes a separate embodiment, and the combination of various claims and embodiments are within the scope of the invention.

What is claimed is:

1. An integrated circuit comprising:

a bandgap reference generator comprising:

a first current path comprising a first PMOS transistor; and a first resistor coupled in series with a source-drain path of the first PMOS transistor; and a voltage regulator comprising:

a second current path comprising a second PMOS transistor and mirrored to the first current path;

a third current path comprising a first NMOS transistor, wherein the second current path and the third current path share a same current;

a fourth current path comprising a second NMOS transistor and mirrored to the third current path;

a fifth current path comprising a third PMOS transistor, wherein the fourth current path and the fifth current path share a same current; and a sixth current path comprising a fourth PMOS transistor mirrored to the fifth current path, wherein the sixth current path comprises a second resistor coupled in series with a source-drain path of the fourth PMOS transistor.

2. The integrated circuit of claim 1, wherein a resistance of the second resistor is twice a resistance of the first resistor.

3. The integrated circuit of claim 1, wherein the first current path further comprises a bipolar transistor coupled between the first PMOS transistor and the first resistor, and wherein the sixth current path further comprises two additional bipolar transistors coupled in series, with each of the two additional bipolar transistors comprising a base, and an emitter connected to the base.

4. The integrated circuit of claim 3, wherein the two additional bipolar transistors are substantially identical to the bipolar transistor in the first current path.

5. The integrated circuit of claim 3, wherein the sixth current path further comprises a third NMOS transistor coupled in series with the two additional bipolar transistors, wherein the third NMOS transistor comprises a base, and a drain connected to the base.

6. The integrated circuit of claim 1 further comprising:

a seventh current path comprising:

a first additional NMOS transistor comprising a gate connected to a node in the sixth current path;

a second additional NMOS transistor comprising a gate connected to a gate of a transistor in the fourth current path, wherein a drain of the first additional NMOS transistor is connected to a source of the second additional NMOS transistor; and an output node of the voltage regulator at the drain of the first additional NMOS transistor.

7. The integrated circuit of claim 1, wherein the bandgap reference generator further comprises:

a first bipolar transistor with a collector-emitter path coupled to a source-drain path of the first PMOS transistor in series; and an additional first PMOS transistor comprising a gate connected to the gate of the first PMOS transistor; and a second bipolar transistor with a collector-emitter path coupled to a source-drain path of the additional first PMOS transistor in series, wherein an emitter of the second bipolar transistor is connected to an end of the first resistor.

8. An integrated circuit comprising a bandgap reference generator comprising:

a first current path; and a first bipolar transistor with an emitter-collector path in the first current path;

a voltage regulator comprising a second current path, wherein the second current path mirrors the first current path;

a first resistor configured to receive a current of the second current path;

a second bipolar transistor, wherein a base and a collector of the second bipolar transistor are interconnected; and a third bipolar transistor connected in series with the second bipolar transistor and the first resistor, wherein a base and a collector of the third bipolar transistor are interconnected.

9. The integrated circuit of claim 8 further comprising:

a first NMOS transistor comprising a first gate, and a first drain connected to the first gate, wherein a source-drain path of the first NMOS transistor is connected in series with emitter-collector paths of the second bipolar transistor and the third bipolar transistor;

a second NMOS transistor comprising a second gate, a second source, and a second drain, wherein the second gate is connected to the first drain of the first NMOS transistor; and an output node of the voltage regulator connected to the second drain of the second NMOS transistor.

10. The integrated circuit of claim 8 further comprising:

a first current mirror comprising:

a third current path mirrored to the first current path; and a fourth current path mirrored to the third current path; and a second current mirror comprising:

the fourth current path; and a fifth current path mirrored to the fourth current path, wherein a current of the fifth current path flows into the second current path.

11. The integrated circuit of claim 10 further comprising:

a sixth current path mirroring the fourth current path; and an output node of the voltage regulator in the sixth current path.

12. The integrated circuit of claim 11, wherein the sixth current path comprises an additional NMOS transistor comprising a gate connected to gate of a transistor in the fourth current path, wherein a drain of the additional NMOS transistor is connected to the output node.

13. The integrated circuit of claim 8, wherein the second current path is configured to:

receive a current of a first additional current path, wherein the first additional current path comprises the second bipolar transistor and the third bipolar transistor, with a collector and a base of each of the second bipolar transistor and the third bipolar transistor being interconnected; and receive a current of a second additional current path mirroring the first additional current path.

14. The integrated circuit of claim 8, wherein a current in the second current path is substantially equal to twice a current in the first current path.

15. An integrated circuit comprising:

a first NMOS transistor comprising a first gate;

a second NMOS transistor comprising a second gate;

a third NMOS transistor comprising a third gate, wherein the first gate, the second gate, and the third gate are interconnected;

a first PMOS transistor comprising a fourth gate, and a drain coupled to a drain of the second NMOS transistor;

a second PMOS transistor comprising a fifth gate;

a third PMOS transistor comprising a sixth gate, wherein the fourth gate, the fifth gate, and the sixth gate are interconnected; and an output resistor configured to receive a first source-drain current of the second PMOS transistor and a second source-drain current of the third PMOS transistor.

16. The integrated circuit of claim 15 further comprising:

a fourth NMOS transistor comprising a gate and a drain interconnected to each other and coupled to a drain of the second PMOS transistor;

a first bipolar transistor comprising a base and a collector interconnected to each other; and a second bipolar transistor comprising a base and a collector interconnected to each other, wherein the first bipolar transistor and the second bipolar transistor are coupled in series with the output resistor, the fourth NMOS transistor, and the second PMOS transistor.

17. The integrated circuit of claim 16 further comprising:

a fifth NMOS transistor comprising a gate connected to the drain of the second PMOS transistor and the drain of the fourth NMOS transistor; and an output node at a source of the fifth NMOS transistor.

18. The integrated circuit of claim 15 further comprising a bandgap reference generator comprising a current path, wherein a source-drain current of the first NMOS transistor mirrors a current of the current path in the bandgap reference generator.

19. The integrated circuit of claim 18, wherein the bandgap reference generator further comprises an additional resistor configured to receive the current of the current path, wherein the output resistor has a first resistance equal to twice a resistance of the additional resistor.

* * * * *